US008757220B2

(12) United States Patent
Scharger

(10) Patent No.: US 8,757,220 B2
(45) Date of Patent: Jun. 24, 2014

(54) METERING DEVICE AND METHOD FOR OPERATING SAID METERING DEVICE

(75) Inventor: Rolf Scharger, Winterbach (DE)

(73) Assignee: Harro Höfliger Verpackungsmaschinen GmbH, Allmersbach im Tal (DE)

( * ) Notice: Subject to any disclaimer, the term of this patent is extended or adjusted under 35 U.S.C. 154(b) by 844 days.

(21) Appl. No.: 12/997,600

(22) PCT Filed: Jun. 13, 2008

(86) PCT No.: PCT/EP2008/004747

§ 371 (c)(1),
(2), (4) Date: Dec. 12, 2010

(87) PCT Pub. No.: WO2009/149727

PCT Pub. Date: Dec. 17, 2009

(65) Prior Publication Data

US 2011/0108157 A1 May 12, 2011

(51) Int. Cl.
*B65B 1/20* (2006.01)

(52) U.S. Cl.
USPC ..... 141/72; 141/2; 141/18; 141/99; 141/83; 141/290; 222/424; 222/199; 222/330; 222/318

(58) Field of Classification Search
USPC ..... 141/2, 18, 72, 99, 83, 249, 285, 290, 141/302; 222/199, 200, 318, 330, 424
See application file for complete search history.

(56) References Cited

U.S. PATENT DOCUMENTS

| | | | | |
|---|---|---|---|---|
| 4,472,091 | A | 9/1984 | Callahan | |
| 4,599,017 | A | 7/1986 | Rüssemeyer et al. | |
| 5,222,529 | A | 6/1993 | Zoltan et al. | |
| 7,950,423 | B2 * | 5/2011 | Poole et al. | 141/67 |

FOREIGN PATENT DOCUMENTS

| | | | |
|---|---|---|---|
| DE | 3310452 | A1 | 9/1984 |
| GB | 871 651 | A | 6/1961 |
| GB | 1 414 967 | A | 11/1975 |

* cited by examiner

*Primary Examiner* — Jason K Niesz
(74) *Attorney, Agent, or Firm* — Gudrun E. Huckett

(57) ABSTRACT

The invention relates to a metering device for fine grained powder (1), in particular for medicinal powder (1) for pulmonary administration, and to a method for operating the metering device. The metering device comprises a powder pump and a metering mechanism (3), wherein the metering mechanism (3) comprises a continuous powder passage (4) and at least one metering chamber (5) with an outlet valve (6). The metering chamber (5) branches off from the powder passage (4) at an angle. The metering chamber (5) has a larger cross section than the powder passage (4). The powder (1) is conveyed through the powder passage (4) by means of the powder pump, the at least one metering chamber (5) being filled with the powder (1) in a self-levelling manner. The conveying by means of the powder pump is then interrupted, and at least one target container is filled from the metering chamber (5) with the outlet valve (6) being opened and a residual quantity of powder (1) remaining in the metering chamber (5).

22 Claims, 2 Drawing Sheets

METERING DEVICE AND METHOD FOR OPERATING SAID METERING DEVICE

BACKGROUND OF THE INVENTION

The invention concerns a metering device for fine grain powder, in particular for medicinal powder for pulmonary administration, as well as a method for operating such metering device.

As a result of the rise in asthma and COPD (chronic obstructive pulmonary disease), administration forms by inhalation of medicines for therapy of these diseases are becoming more and more important. The pulmonary administration—in addition to injection or infusion—is also an alternative for numerous medicines that cannot be applied per orally because the substances would be destroyed in the gastro-intestinal tract or would have an unsatisfactory bioavailability. In this connection, powders for inhalation have in comparison to solutions for aerosol administration the advantage of improved active ingredient stability but are more difficult to process because all active ingredient particles must have a size of <5 μm in order to reach the target location, i.e., alveoli. Powder inhalers with individually packaged doses are preferred because of their better stability and higher metering precision.

Smallest quantities of such powders that, for medical applications, are in the range of 0.2 mg to 50 mg, must be metered very precisely and filled into the target vessel. As a result of the small particle size these powders agglomerate greatly wherein the mass of individual agglomerates may be greater than the permissible metering tolerance. This results in the lack of metering precision in conventional volume-based metering. When these agglomerates upon metering and inhaling remain intact, the active ingredient can reach only to a limited extent the alveoli. The aim is therefore to dissolve these agglomerates during the metering process, to fill in the powder as finely divided as possible into the target container, and to achieve in this connection a high metering precision.

U.S. Pat. No. 4,472,091 discloses a metering device for fine grain dry powder in which the powder is stored in a closed funnel-shaped supply container. The funnel-shaped supply container has at its bottom side an opening that is closed off by means of the discharge valve. The valve body of the discharge valve is axially moveable by means of piezoelements and, in this way, can be opened, closed, and also caused to vibrate. Into the supply container and also into an intermediate space arranged below, an air passage opens, respectively, in order to generate a powder-air mixture which is then passed through the discharge valve into the target container. The vibration movement of the valve body contributes to loosening of the powder and to an improved discharge from the supply container.

A disadvantage in this connection is that breaking up of the agglomerates in the powder cannot be ensured in a reliable fashion. In particular, a complex sensor system and a corresponding process control are required in order to maintain a satisfactory filling level of the powder in the supply container. When dropping below the minimally required filling level, the container must be opened and refilled which impairs the economic efficiency of the arrangement. The arrangement is complex with respect to its configuration. The piezoelectric drive of the valve body is positioned within the powder stream and therefore must be protected with respect to soiling and to prevent contamination of the powder.

The invention has therefore the object to provide a metering device for fine grain powder that, while of a simple configuration and minimal operating expenditure, provides a precise and economic metering of the powder.

SUMMARY OF THE INVENTION

This object is solved by a metering device for fine grain powder, in particular for medicinal powder for pulmonary administration, comprising a powder pump for conveying the powder and a metering mechanism supplied by the powder pump with the powder, wherein the metering mechanism comprises a continuous powder passage and at least one metering chamber with an outlet valve, wherein the metering chamber branches off the powder passage at an angle, and wherein the metering chamber has a greater cross-section than the powder passage.

The invention has further the object to provide a method for operating the metering device with which the powder can be metered exactly and economically while the agglomerates are broken up.

This object is solved by a method for operating a metering device of the present invention, comprising the following method steps:

- by means of the powder pump the powder is conveyed through the powder passage, whereby the least one metering chamber is filled with the powder;
- after a lapse of a time interval in which a self-leveling filling of the metering chamber has taken place, the conveying action of the powder by the powder pump is interrupted,
- subsequently, filling of at least one target container from the metering chamber is carried out while the outlet valve is opened and a residual quantity of powder in the metering chamber is maintained;
- finally, the conveying action of the powder by means of the powder pump is resumed until again a self-leveling filling of the metering chamber has taken place, whereupon further filling of target containers and further self-leveling filling of the metering chamber take place.

A metering device for fine grain powder, in particular for medicinal powder for pulmonary administration, is proposed wherein the metering device comprises a powder pump for conveying the powder and a metering mechanism that is supplied by the powder pump with the powder. The metering mechanism comprises a continuous powder passage and at least one metering chamber with an outlet valve wherein the metering chamber branches off the powder passage at an angle and wherein the metering chamber has a greater, diameter than the powder passage.

In the correlated method according to the invention the powder is conveyed by means of the powder pump through the powder passage, whereby the at least one metering chamber is filled with the powder. The volume flow of the powder, of a powder-air mixture, or a powder-gas mixture conveyed by the powder pump has in the powder passage of the metering mechanism as a result of its cross-section a certain velocity. At the branch locations of the at least one or several metering chambers with larger cross-section, the flow cross-section increases as a whole so that the flow velocity is reduced. As a result of this, the conveyed powder can drop from the powder passage or its carrier air stream into the metering chamber so that the latter is filled with the powder. In the filled state the widening of the free flow cross-section in the powder passage is no longer existing so that a reduction of the flow velocity no longer occurs. As a result of this, no further powder will drop into the metering chamber so that a self-leveling filling of the metering chamber with powder without overfilling is realized.

A filling level control of the metering chamber is not required. Instead, only the lapse of a time interval is observed in which the self-leveling filling of the metering chamber is taking place. Subsequently, conveying of the powder by means of the powder pump is interrupted.

Subsequently, filling of at least one target container from the metering chamber by opening the outlet valve and by maintaining a residual amount of powder in the metering chamber is carried out. The volume of the metering chamber is preferably of such a size that several, and in particular four, target containers can be filled directly one after another from a single metering chamber without the powder supply in the metering chamber being depleted.

After filling of the target container and closing of the outlet valve, finally conveying of the powder by means of the powder pump is resumed until again a self-leveling filling of the metering chamber has taken place so that a further filling of target containers and further self-leveling filling of the metering chamber take place.

The arrangement is simple with respect to its configuration and requires neither special devices nor processing steps for a controlled refilling of the metering chamber. Instead, without a monitoring sensor system a self-leveling refilling action takes place so that with minimal constructive expenditure a high processing safety is obtained. Preferably, several, and in particular six, metering chambers branch off the continuous powder passage. In connection with the sequential filling of several, in particular four, target containers with one metering chamber each, the target containers, for example, in the form of hard gel capsules, so-called vials, and other target vessels can be filled in a matrix-shaped frame for accommodating a plurality of target containers. The time that is required for exchanging this frame with the target containers after completion of filling can be used for the self-leveling refilling of the metering chambers by means of the powder pump so that no temporal delay is caused by it. The metering device and the correlated method can be utilized with an appropriately high economic efficiency.

In a preferred embodiment the powder passage in operation is arranged horizontally while the at least one metering chamber branches off at a right angle from the powder passage and is thus arranged vertically with its longitudinal axis. By utilizing the acting force of weight, in this way a reliable diversion of the powder out of the powder passage into the metering chamber is ensured.

In a preferred embodiment, the powder pump, a supply line that extends from the powder pump to the metering mechanism, the powder passage, and a return line returning from the metering mechanism to the powder pump provide a dosed circuit for the powder. In this way, the powder can be conveyed with excess but without losses through the powder passage and back to the powder pump wherein, as a result of the afore described self-leveling action, the quantity required for filling the metering chamber is separated automatically from the powder stream. Even for a plurality of sequentially arranged metering chambers branching off the powder passage it is ensured that in each individual metering chamber the required filling level is reached.

It has been found to be expedient that the cross-section of the metering chamber in the connecting area to the powder passage is at least twice as large, and in particular at least three times, as large as the cross-section of the powder passage. In this way, a satisfactory flow delay is ensured in the aforementioned connecting area that enables an automatic drop of the powder particles out of the conveyed volume flow into the metering chamber.

The outlet valve is preferably a particularly conical valve that opens toward the exterior of the metering chamber. In the open state, the exiting powder, externally to the valve seat, flows about the valve body that is moved outwardly and the powder is thus deflected by it, which also contributes to loosening the powder. A subsequent closing movement of the valve body opposite to the exiting powder stream avoids that residual powder is compressed in an undesirable way on the valve seat.

In a preferred embodiment, the outlet valve comprises a valve needle that extends into the interior of the metering chamber and that supports at least one radially projecting loosening projection for the powder. The axial movement of the valve needle contributes in this connection by means of the loosening projection to the loosening of the powder and of agglomerates formed therein. Expediently, the loosening projection is arranged at an axial spacing to the valve seat of the outlet valve in the interior of the metering chamber. As a result of the spatial distance of the loosening projection to the valve seat, a reliable fluidization of the powder upstream of the valve seat is ensured so that the powder as a whole can exit uninterrupted through the outlet valve. The loosening projection can have different suitable shapes. Expediently, it is embodied as a plate surrounding the valve needle so that the loosening movement of the valve needle is transferred uniformly onto the surrounding powder.

In a preferred embodiment, a first drive for the valve needle for opening and dosing the outlet valve as well as a second drive that is in particular connected serially with the first drive for providing an oscillating movement of the valve needle are provided. In a corresponding method step, the first drive that is adapted for this purpose carries out the appropriate large stroke for opening or closing the outlet valve. For loosening the powder, a smaller stroke that is however to be carried out at high frequency is required that is carried out by means of the second drive especially adapted for this purpose so that when the outlet valve is open by means of the second drive an oscillating movement, in particular in the longitudinal axis of the valve needle, is carried out for loosening the powder. As a result of the specialization of the two drives to their different tasks, on the one hand, a faster delay-free opening and closing and, on the other hand, loosening of the powder and thus an agglomerate-free exit of the powder from the metering chamber are ensured in a reliable way.

The valve needle is expediently passed in longitudinal direction through the metering chamber wherein the two drives engage the valve needle on the side opposite the outlet valve. In an embodiment with only one drive, the same holds true. The drives and their connection to the valve needle are thus not positioned within the volume flow of the powder exiting from the metering chamber so that independent protective measures are not required. The individual metering chambers, including their drives, can be designed to be very slim in a coaxial configuration so that they can be positioned closely adjacent to each other within the same grid as the target containers. The simultaneous parallel filling of the target containers is thus possible in a simple way.

In a preferred embodiment of the invention with respect to the method, the filling quantity of the powder received in the target container is determined by means of a weighing cell for the target container wherein the outlet valve is controlled and regulated by means of the measured result of the weighing cell. During the filling process of the target container, i.e., when the outlet valve is open, weighing of the filled-in quantity in the target container is carried out continuously. Upon reaching the predetermined target quantity the outlet valve is closed. In connection with the afore described constructive features and the thus achieved agglomerate-free powder processing very fast reaction times are obtainable so that a surprisingly high metering precision can be achieved.

BRIEF DESCRIPTION OF THE DRAWINGS

An embodiment of the invention will be explained in the following with the aid of the drawing in more detail. It is shown in.

DESCRIPTION OF PREFERRED EMBODIMENTS

Figure 1:
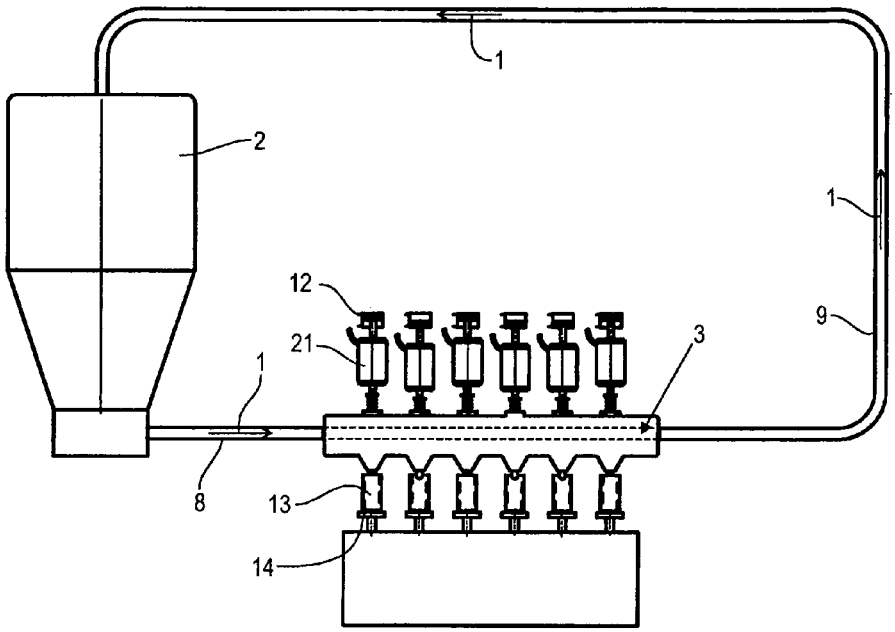
FIG. 1 in a side view a metering device according to the invention with a powder pump, a metering mechanism, and a closed circuit for the powder.

FIG. 1 shows in a side view a metering device according to the invention for fine grain powder 1, in the illustrated embodiment for medicinal powder 1 for pulmonary administration, with a grain size of ≤5 μm. The metering device comprises a powder pump 2 for conveying the powder 1, as indicated by the arrows, and a metering mechanism 3 that is supplied by the powder pump 2 with the powder 1. The metering mechanism 3 is provided with at least one, here in exemplary fashion with six, metering chambers 5 illustrated in FIG. 3 for simultaneous metering of the powder 1 and filling of the same number of target containers 13. A deviating number of metering chambers 5 may be expedient also. The target containers 13 can be comprised of hard gelatin capsules, vials or other target vessels that are used with the appropriate powder quantity in an inhalation device, not illustrated. The target containers 13 are positioned on a weighing cell 14, respectively, by means of which the degree of filling of the target containers 13 is determined.

Figure 2:
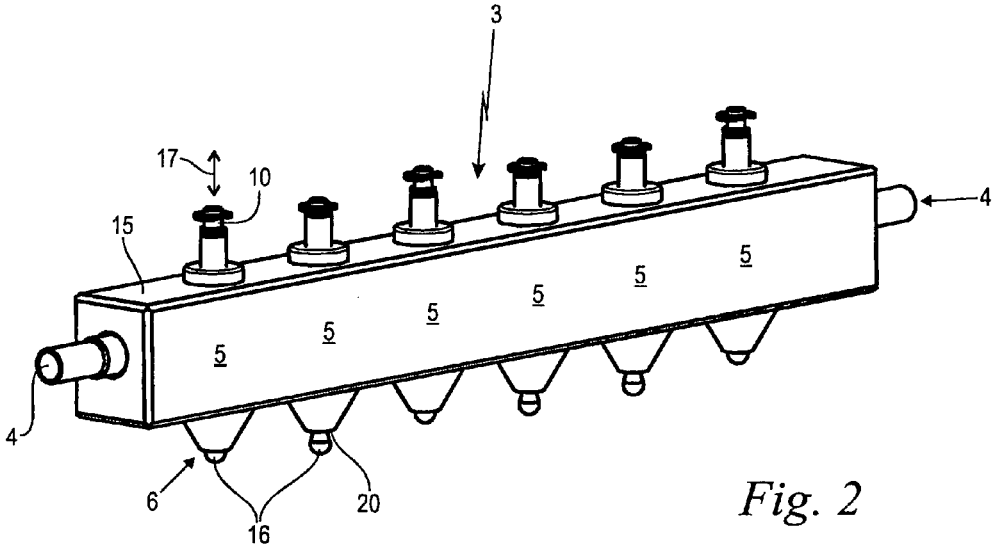
FIG. 2 a perspective view of the metering mechanism according to FIG. 1 with details of its constructive configuration.
Figure 3:
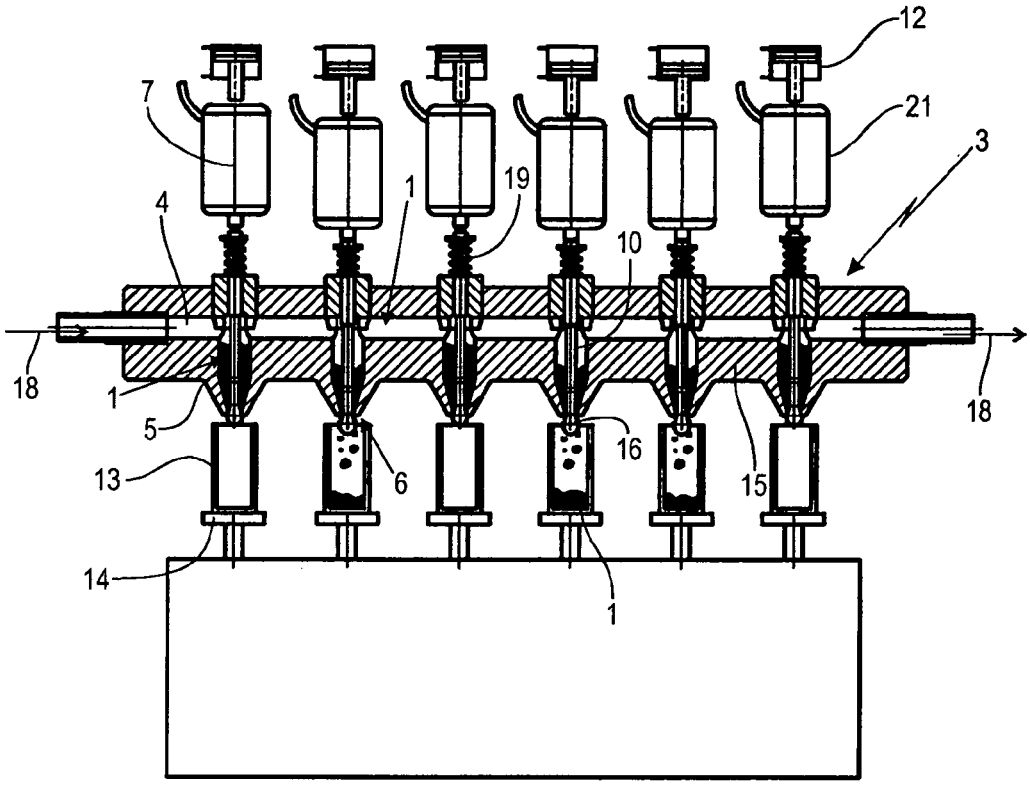
FIG. 3 a longitudinal section illustration of the metering mechanism according to FIGS. 1 and 2 with details of the relative arrangement of powder passage, metering chambers, target containers and weighing cells.
Figure 4:
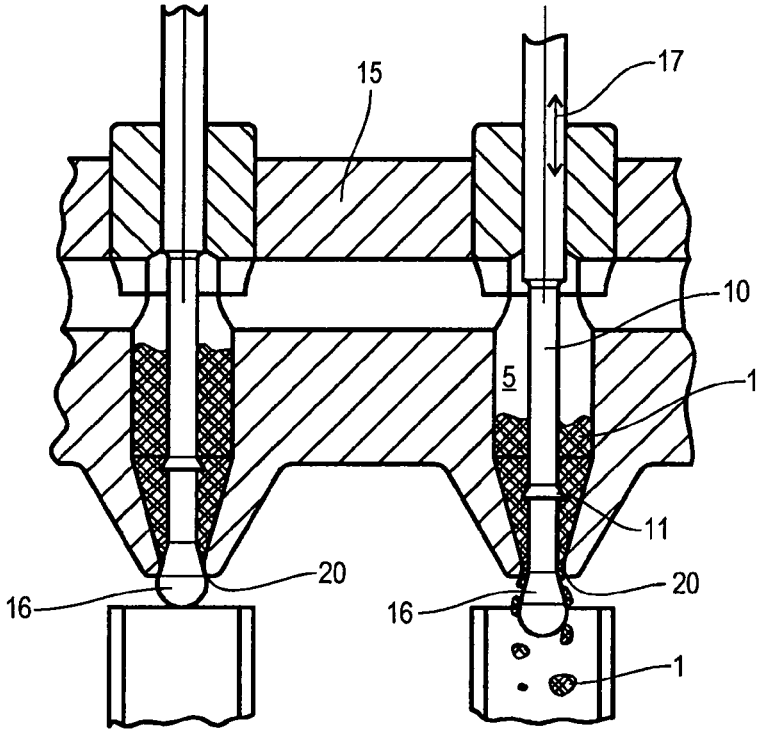
FIG. 4 an enlarged detail illustration of the arrangement according to FIG. 3 with details in regard to the design of the valve needle and the outlet valve.

Through the metering mechanism 3, in its longitudinal direction, the powder passage 4 illustrated in FIGS. 2 to 4 extends which together with the powder pump 2, a supply line 8 that extends from the powder pump 2 to the metering mechanism, and a return line that returns from the metering mechanism 3 to the powder pump 1, a closed circuit for the powder 1 in accordance with the indicated arrows is formed.

FIG. 2 shows a perspective exterior view of the metering mechanism 3 according to FIG. 1 with details of its constructive configuration. The metering mechanism 3 comprises a housing 15 extending in a longitudinal direction through which the powder passage 4 extends in axis-parallel arrangement. In the housing 15 there are several, here six, metering chambers 5 that are illustrated in more detail in FIG. 3, each having at their lower end in the direction of the force of weight an outlet valve 6. The outlet valves 6 each comprise a continuously extending valve needle 10 which in the area of the outlet valve 6 is provided with a valve body 16 for opening and closing the respective outlet valve 6. The valve needles 10 in their longitudinal direction pass through the metering chambers 5 (FIG. 3) wherein, at their lower end, they are projecting with their respective valve body 16 out of the outlet valve 6 and wherein, at the upper end opposite the outlet valve 6, they project from the housing 15. At this end opposite the outlet valve 6, in accordance with the illustration of FIGS. 1 and 3, a first drive 12 an a second drive 21 are connected to the valve needle 10 so that all valve needles 10, independent from one another, are axially moveable in accordance with a double arrow 17. Three of the total of six valve needles 10 are shown in their closed position wherein the corresponding valve body 16 rest seal-tightly on the valve seat 20 that is formed in the housing 15 while the further three valve needles are pushed downwardly so that the corresponding valve body 16 is lifted downwardly off the valve seat 20 and opens the respective outlet valve 6. The stroke movement between the afore described closed and open positions in the direction of the double arrow 17 is realized by means of the correlated first drive 12. Moreover, by means of the second drive 21 an oscillating stroke movement in the longitudinal direction of the valve needle 10 in accordance with the arrow 17 can be initiated.

FIG. 3 shows a longitudinal section illustration of the metering mechanism 3 according to FIGS. 1 and 2 with details of the respective arrangement of the powder passage 4, the metering chambers 5, the target containers 13, and the weighing cells 14. It can be seen that the powder passage 4 in longitudinal direction extends through the housing 15 wherein the powder passage 4 in operation is horizontal, i.e., transverse to the direction of the force of weight. At least one metering chamber 5 branches at an angle off the powder passage 4 wherein in the illustrated embodiment several, here a total of six, metering chambers 5 are provided. The metering chambers 5 have, like the powder passage 4, a cylindrical shape, but extend in this connection along their longitudinal axis 7 that is at a right angle to the longitudinal axis of the powder passage 4, respectively, and in this connection is arranged vertically, i.e., extends in the direction of the force of weight. In the connecting area of the metering chambers 5 adjoining the powder passage 4, the metering chambers 5 have a larger cross-section than the powder passage 4. In the illustrated embodiment, the cross-section of the metering chambers 5 in this connecting area is at least twice as large, and here at least three times as large, as the cross-section of the powder passage 4.

Each of the metering chambers 5 has at its lower end in the direction of the force of weight a conically tapering section that in the direction of the exterior side of the metering chambers 5 or the exterior side of the metering mechanism 3 are provided with an outlet valve 6, respectively. The outlet valve 6 comprises a valve seat 20 that is integrally formed in the housing 15 and illustrated in FIG. 4 as well as a valve needle 10 with an integrally formed valve body 16 that in the closed state is resting on the valve seat 20 (FIG. 4) of the housing 15 and thus closes the outlet valve 6. Three of the total of six valve needles 10 are illustrated in downwardly displaced position in comparison to the other three valve needles 10 wherein the valve body 16 is lifted off the valve seat 20 that is formed integrally in the housing 15 (FIG. 4). In this state, the respective outlet valve 6 is open. The axial opening movement of the valve needle 10 is realized in the opening direction against the pretension of a pressure spring 19 by means of the first, here pneumatic, drive 12. Instead of the pneumatic drive 12 also an electromagnetic embodiment or the like can be expedient.

Between the first drive 12 and the upper shaft end of the valve needle 10 there is a second drive 21. It is connected in series with the first drive 12 in such a way that the second drive 21 together with the valve needle 10 carries out the stroke generated by the first drive 12. The second drive 21 is embodied like the first drive 12 as a linear drive but, in deviation therefrom, designed for smaller but high-frequency strokes. For this purpose, it is embodied as a piezoelectric drive. However, also deviating configurations such as electromagnetic drives can be expedient. By means of the second drive 21, the valve needle 10, as needed, can be caused to perform an axial oscillating stroke movement. As a result of the serial connection of both drives 12, 21 their two stroke movements are overlaid but can also be, independently from one another, switched on, controlled or regulated, and also switched off.

FIG. 4 shows an enlarged detail illustrations of the arrangement according to FIG. 3 where the same features are identified with same reference numerals. The valve body 16 is positioned on the exterior side of the housing 15 and forms together with the correlated valve seat 20 a valve that opens toward the exterior side of the metering chamber 5 or the housing 15. This shape of the valve body 16 of the corresponding valve seat 20 is conical in the sealing area which leads to a fine distribution of the exiting powder 1. In other respects, the valve body 16 is of a rounded configuration.

The valve needle 10 extends through the interior of the metering chamber 5. The valve needles 10 may have a smooth shaft. Moreover, the valve needles 10 may be provided with different radially projecting loosening projections 11 for the powder. In this connection, at least one such a loosening projection 11 is to be provided. It may be expedient to have several, in particular up to three, such loosening projections 11 on a single valve needle 10. These loosening projections 11 can be in the form of radially projecting teeth or the like and in the illustrated embodiment are embodied in the form of a plate surrounding the shaft of the valve needle 10, wherein, in this connection, preferably only one such loosening projection is arranged on each valve needle 10. The loosening projections 11 are not located in immediate vicinity of the respective outlet valve 6 but at an axial spacing to the valve seat 20 in the interior of the respective metering chamber 5. The axial position of the respective loosening projections 11 is advantageously in the area of the conically tapering section or in the transition area to the cylindrical section of the metering chamber 5.

With simultaneous reference to FIGS. 1 to 4, in the following the method according to the invention for operating the metering device is described. First, by means of the powder pump 2 the powder 1 is conveyed through the powder passage 4 in the form of the afore described closed circuit. Inasmuch as the metering chambers 5 are not filled or not completely filled with the powder 1, in the connecting area between the metering chambers 5 and the powder passage 4 a widened flow cross-section is provided in which the powder stream in the powder passage 4 indicated by arrows 18 (FIG. 3) is delayed. As a result of this delay, a portion of the powder 1 drops out of the powder passage 4 into the powder chambers 5 so that as a result of this their filling level will rise. Upon reaching a certain filling level, i.e., when the powder fill in the metering chamber 5 approaches the powder passage 4, this cross-sectional expansion and the thus resulting flow delay no longer exist so that no additional powder will drop into the metering chambers 5. While the powder pump 2 is running and a continuous stream of the powder 1 in the powder passage 4 is present, a self-leveling filling level regulation of the powder 1 in the metering chambers 5 is generated.

The powder pump can continue to run as long as desired without an overfill occurring. Actually, it must only run as long as required for filling the metering chambers 5. This time period is used in order to position the target containers 13 (FIG. 1) on the weighing cells 14 below the metering mechanism 3. One target container 13 each is positioned below an outlet valve 6 with the corresponding metering chamber 5. After lapse of a certain time interval that is at least so long that a self-leveling filling of the metering chamber 5 has occurred, conveying of the powder 1 by means of the powder pump 2 is interrupted. Subsequently, the valve needles 10 are forced by means of the first drive 12 in accordance with the double arrow 17 in such a way downwardly that the respective valve body 16 is lifted off the corresponding valve seat 20. A powder of an appropriate fine grain form with distinct tendency to form agglomerates will then not yet drop automatically out of the metering chambers 5. Therefore, after opening of the outlet valves 6 and maintaining the open state, the second drives 21 are switched on so that the valve needles 10 with opened outlet valve 6 are moved oscillatingly in direction of the longitudinal axis 7 and the double arrow 17 and, by friction between the shaft of the valve needles 10 and the powder 1, a loosening action is generated. This loosening action with breaking up of the agglomerates in the powder 1 is enhanced by the oscillating loosening projections 11 so that a uniform powder stream will exit through the outlet valve 6 and drop into the target containers 13 as a result of its own weight.

While this is happening, a continuous and individual weighing of the target containers 13 by means of the correlated weighing cells 14 takes place so that the filled-in quantity of the powder received in the target container 13 is determined. The outlet valve 6 or the correlated drives 12, 21 are controlled or regulated by means of the measuring results of the weighing cells 14 in such a way that the second drive 21 upon reaching the predetermined filled-in quantity in the target container 13 is switched off at a high reaction speed. Continued flow of the powder 1 out of the metering chambers 5 will then be stopped immediately. In assisting this process, immediately after switching off the second drive 21 closing of the outlet valve 6 by means of the correlated first drive 12 will happen. The typical metering quantity for an individual target container 13 is in a range of including 0.2 mg to including 50 mg.

It may be expedient to arrange precisely the same quantity of target containers 13 in a row as metering chambers 5 are present. After filling of these target containers 13 by means of one metering chamber 5 each and with closed outlet valves 6, conveying of the powder 1 by means of the powder pump 2 is resumed until again a self-leveling filling of the metering chambers 5 has taken place. During this time, a new row of still empty target containers 13 can be positioned below the metering chambers 5 for a subsequent filling process that is then occurring anew in the above described way.

Alternatively, it can also be expedient to arrange a larger quantity of target containers 13, for example, in a frame in a matrix shape. The volume of the metering chambers 5 is then dimensioned such that the powder supply collected therein is sufficient for filling several, in this case four, target containers 13, wherein after filling four supply containers 13 from one metering chamber 5 there is still a residual quantity of powder 1 in each metering chamber 5. In this case, up to four target containers 13 are sequentially filled between two sequential filling actions of the correlated metering chambers 5. Only then the powder pump 1 is operated again in order to refill the metering chambers 5 wherein this refilling action is done during exchange of the filled target containers 13 for a new frame with new, still empty, target containers 13.

What is claimed is:

1. A metering device for fine grain powder, in particular for medicinal powder for pulmonary administration, the metering device comprising:

a powder pump for conveying the powder;

a metering mechanism supplied by the powder pump with the powder;

wherein the metering mechanism comprises a continuous powder passage and at least one metering chamber with an outlet valve, wherein the metering chamber branches off the powder passage at an angle, and wherein the metering chamber has a greater cross-section than the powder passage;

wherein the outlet valve comprises a valve needle that extends into an interior of the metering chamber and supports at least one radially projecting loosening device for the powder, wherein the valve needle is adapted to carry out an oscillating movement in a longitudinal direction of the valve needle for loosening the powder.

2. The metering device according to claim 1, wherein the powder passage in operation is arranged horizontally and the metering chamber branches off the powder passage at a right angle and has a longitudinal axis that is arranged vertically.

3. The metering device according to claim 1, wherein several of the metering chamber branch off the continuous powder passage.

4. The metering device according to claim 3, wherein six of the metering chamber branch off the continuous powder passage.

5. The metering device according to claim 1, further comprising a supply line extending from the powder pump to the metering mechanism and a return line returning from the metering mechanism to the powder pump, wherein the powder pump, the supply line, the powder passage, and the return line form a closed circuit for the powder.

6. The metering device according to claim 1, wherein a cross-section of the metering chamber in a connecting area to the powder passage is at least twice as large as a cross-section of the powder passage.

7. The metering device according to claim 6, wherein the cross-section of the metering chamber in the connecting area to the powder passage is at least three times as large as a cross-section of the powder passage.

8. The metering device according to claim 1, wherein the outlet valve opens toward the exterior side of the metering chamber.

9. The metering device according to claim 8, wherein the outlet valve is a conical valve.

10. The metering device according to claim 1, wherein the loosening projection is arranged at an axial spacing to a valve seat of the outlet valve in the interior of the metering chamber.

11. The metering device according to claim 10, wherein the loosening projection is embodied as a plate circumferentially extending about the valve needle.

12. The metering device according to claim 1, comprising a first drive acting on the valve needle for opening and closing the outlet valve and a second drive acting on the valve needle for generating the oscillating movement in the longitudinal direction of the valve needle.

13. The metering device according to claim 12, wherein the second drive is connected in series with the first drive.

14. The metering device according to claim 12, wherein the valve needle extends longitudinally through the metering chamber and the first and second drives engage the valve needle at an end opposite the outlet valve.

15. A method for operating a metering device according to claim 1, comprising:

conveying by the powder pump the powder through the powder passage and filling the metering chamber with the powder in a self-leveling filling action;

after a lapse of a time interval in which the metering chamber has been filled by the a self-leveling filling action, interrupting conveying of the powder by the powder pump;

subsequently, filling at least one target container with the powder from the metering chamber by opening the outlet valve and maintaining a residual quantity of the powder in the metering chamber;

causing the valve needle to carry out an oscillating movement in a longitudinal direction of the valve needle for loosening the powder during filling of the powder from the metering chamber into the target container while the outlet valve is open;

closing the outlet valve after completion of filling of the target container;

resuming conveying of the powder by the powder pump until again a self-leveling filling action of the metering chamber is completed, followed by further filling of target containers and further self-leveling filling of the metering chamber.

16. The method according to claim 15, wherein between two sequentially following fillings of the metering chamber several target containers are filled with the powder from a single metering chamber.

17. The method according to claim 16, wherein between two sequentially following fillings of the metering chamber four target containers are filled with the powder from a single metering chamber.

18. The method according to claim 15, further comprising the steps of determining a filling quantity of the powder in the target container by a weighing cell for the target container and controlling or regulating the outlet valve based on a measuring result of the weighing cell.

19. The method according to claim 15, comprising the step of switching on the second drive only after the outlet valve has been opened.

20. The method according to claim 15, providing a first drive acting on the valve needle and a second drive acting on the valve needle, wherein the first drive effects opening and closing of the outlet valve, and wherein the second drive causes the oscillating movement of the valve needle in the longitudinal direction.

21. The method according to claim 15, wherein the valve needle carries out a stroke movement between an open position and a closed position.

22. The method according to claim 1, wherein the valve needle is adapted to carry out a stroke movement between an open position and a closed position.

* * * * *